US009266321B2

(12) United States Patent
Anderson et al.

(10) Patent No.: US 9,266,321 B2
(45) Date of Patent: Feb. 23, 2016

(54) REPLACEABLE PRINTING COMPONENT WITH FACTORY IDENTITY CODE

(75) Inventors: Daryl E. Anderson, Corvallis, OR (US); Andrew L. Van Brocklin, Corvallis, OR (US); Jefferson P. Ward, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/413,215

(22) PCT Filed: Aug. 30, 2012

(86) PCT No.: PCT/US2012/053185

§ 371 (c)(1), (2), (4) Date: Jan. 6, 2015

(87) PCT Pub. No.: WO2014/035408

PCT Pub. Date: Mar. 6, 2014

(65) Prior Publication Data

US 2015/0191007 A1 Jul. 9, 2015

(51) Int. Cl.

*B41J 29/393* (2006.01)
*B41J 2/045* (2006.01)
*B41J 2/175* (2006.01)

(52) U.S. Cl.

CPC ..... *B41J 2/04508* (2013.01); *B41J 2/0458* (2013.01); *B41J 2/04506* (2013.01); *B41J 2/04528* (2013.01); *B41J 2/04581* (2013.01); *B41J 2/04586* (2013.01); *B41J 2/1753* (2013.01); *B41J 2/17546* (2013.01); *B41J 2/17526* (2013.01)

(58) Field of Classification Search

CPC . B41J 2/17543; B41J 2/17546; B41J 2/17526
See application file for complete search history.

(56) References Cited

U.S. PATENT DOCUMENTS

| | | | | |
|---|---|---|---|---|
| 6,719,397 | B1 * | 4/2004 | Hu et al. | 347/19 |
| 7,722,172 | B2 | 5/2010 | Silverbrook | |
| 8,113,641 | B2 | 2/2012 | Silverbrook | |
| 2006/0098993 | A1 | 5/2006 | Yang | |
| 2007/0057982 | A1 | 3/2007 | Adkins et al. | |
| 2007/0097161 | A1 | 5/2007 | Ejiri et al. | |
| 2012/0317662 | A1 * | 12/2012 | Neo et al. | 726/34 |

FOREIGN PATENT DOCUMENTS

| | | | |
|---|---|---|---|
| CN | 103733203 | A | 4/2014 |
| TW | 201007496 | A | 2/2010 |

OTHER PUBLICATIONS

International Searching Authority, "International Search Report," issued in connection with PCT Application Serial No. PCT/US2012/053185, mailed Mar. 28, 2013, 13 pages.
International Searching Authority, "Written Opinion," issued in connection with PCT Application Serial No. PCT/US2012/053185, mailed Mar. 28, 2013, 4 pages.

* cited by examiner

*Primary Examiner* — Lisa M Solomon
(74) *Attorney, Agent, or Firm* — HP Inc. Patent Department

(57) ABSTRACT

In one example implementation, a replaceable printing component includes a fluid supply chamber, and a printhead on the fluid supply chamber. The printhead includes a memory storing a factory identification code that comprises a combination of digitized analog performance parameters. The printhead also includes electronic test components from which the analog performance parameters have been measured.

13 Claims, 5 Drawing Sheets

REPLACEABLE PRINTING COMPONENT WITH FACTORY IDENTITY CODE

RELATED APPLICATION

This patent claims priority to International Patent Application No. PCT/US12/53185, which was filed on Aug. 30, 2012. The foregoing International Patent Application is hereby incorporated herein by reference in its entirety.

BACKGROUND

Printing systems have replaceable components that are integral to the functioning of the system. The replaceable components include print cartridges that contain consumable material that is depleted with each use of the printing system. Verifying that a replaceable component is an authentic component from a legitimate manufacturer can help users of printing systems avoid problems associated with the unintended use of a defective and/or counterfeit component.

BRIEF DESCRIPTION OF THE DRAWINGS

The present embodiments will now be described, by way of example, with reference to the accompanying drawings, in which.

DETAILED DESCRIPTION

Overview

Figure 1:
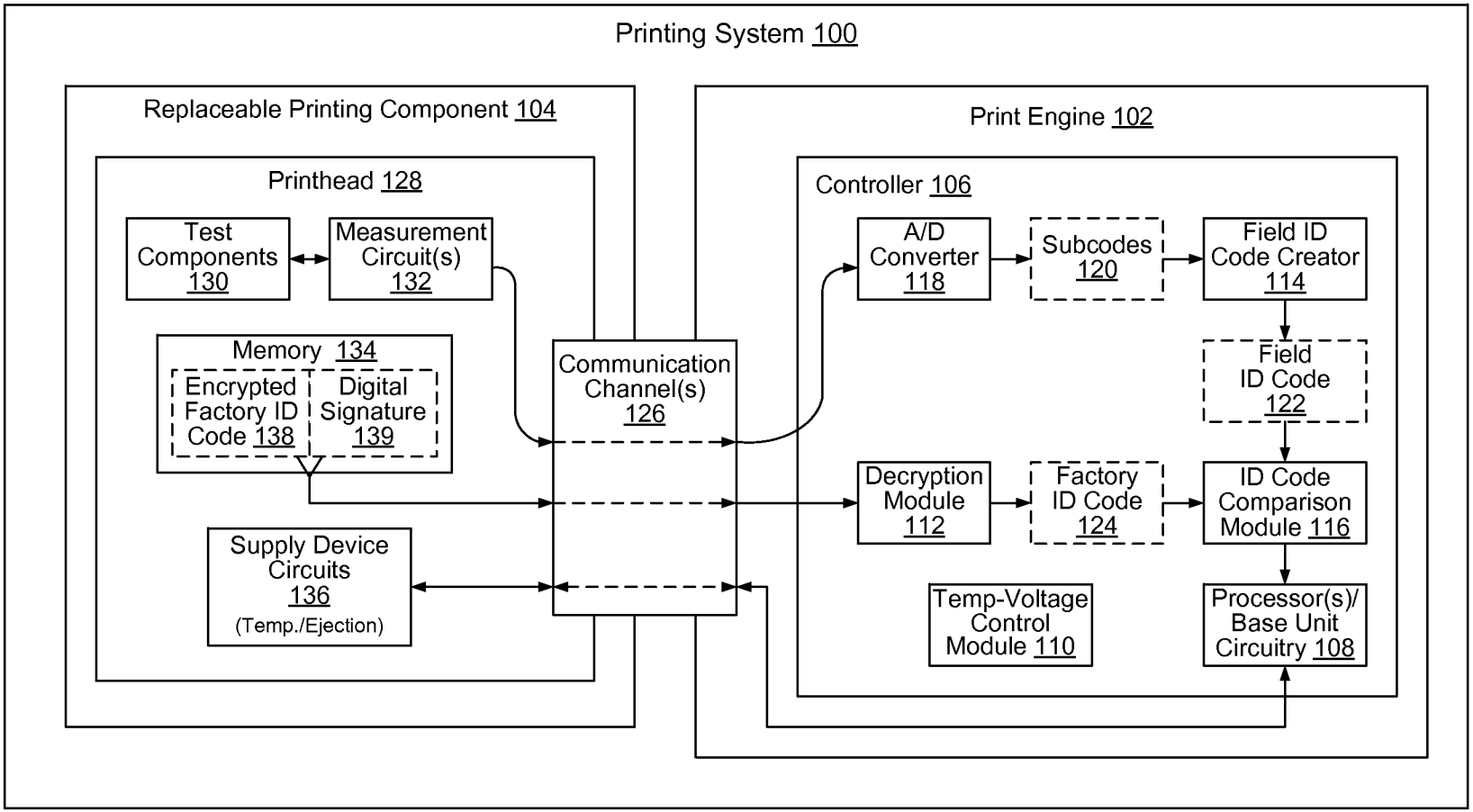
FIG. 1 shows a printing system that includes a print engine and a replaceable printing component, according to an embodiment.

As noted above, verifying the authenticity of replaceable components for use in printing systems can help system users avoid problems associated with the unintended use of defective and/or counterfeit components. For example, the inadvertent use of a counterfeit toner or ink cartridge in a printer system can result in various problems ranging from poor quality printouts to leaky cartridges that can damage the printing system.

Prior methods of authenticating replaceable printing components have included storing identification data in a data chip on the component and then verifying that the identification data is correct when the component is inserted into the printing system (e.g., inkjet printer). For example, a replaceable print cartridge for an inkjet printer can incorporate a data storage chip having identification (ID) bit memory cells that are pre-programmed with digital values of logic "1" (high) or logic "0" (low). When a print cartridge is inserted into the printer, a printer controller determines whether or not the cartridge is authentic by reading (i.e., measuring) the logic values in the ID bit memory cells and comparing them with a threshold value to see if they match expected logic values that were pre-programmed into the memory cells. With this method, therefore, the threshold criteria merely determine whether the ID bit memory cells contain expected logic high values or logic low values. However, ID bit memory cells can have significant electrical defects, or they can be inappropriately modified (e.g., by a counterfeiter), which can result in their returning expected logic high or logic low values when measured. As a result, this method of authentication does not always adequately detect damaged and/or inappropriately modified ID bits, which can lead to the improper authentication of some replaceable printing components.

Embodiments of the present disclosure provide unique identification codes for replaceable printing components such as ink cartridges in inkjet printing systems. Printers can confirm the identity of replaceable ink or toner cartridges based on measurements of analog performance parameters taken from electronic components (e.g., transistors) fabricated on silicon printhead devices within the ink cartridges. The uniqueness of the identifications is enhanced by measuring and combining multiple analog parameters, and by measuring the analog parameters at varying voltages and temperatures.

Variations in measured analog parameters indicate or identify differences in process parameters of individual electronic components, such as diffusion depths, oxide thicknesses, polysilicon gate widths, and metal trace interconnect widths. Such differences are the result of limitations in the photolithographic process, non-uniform conditions encountered while diffusing impurities (dopants) into the silicon, non-uniform conditions encountered while depositing materials on the silicon, and so on. Analog performance parameters that can be measured to identify variations in process parameters include, for example, transistor threshold voltage, saturation current, and resistance. Because no two silicon printhead devices are manufactured identically, individual electronic component (e.g., transistor) parameters vary from printhead to printhead such that no two silicon printhead devices perform identically. Consequently, these process-based parametric variations can be used as the basis for generating identification codes that can uniquely identify individual printheads.

In one example implementation, a replaceable printing component includes a fluid supply chamber, and a printhead on the fluid supply chamber. The printhead includes a memory storing a factory identification code that comprises a combination of digitized analog performance parameters. The printhead also includes electronic test components from which the analog performance parameters have been measured.

In another example implementation, a replaceable printing component includes a fluid supply chamber, and a printhead on the fluid supply chamber having a memory and a plurality of test components. An encrypted factory identification code stored in the memory comprises a combination of digitized analog performance parameters measured on the test components. The encrypted factory identification code has been encrypted using an encryption algorithm selected from the group consisting of RSA (Rivest-Shamir-Adleman), DSA (Digital Signature Algorithm), ECDSA (Elliptic Curve Digital Signature Algorithm), 3DES (Triple Data Encryption Algorithm) and AES (Advanced Encryption Standard).

Illustrative Embodiments

FIG. 1 shows an printing system 100 that includes a print engine 102 and a replaceable printing component 104, according to an embodiment of the disclosure. The print engine 102 of printing system 100 comprises a controller 106 that includes components of a standard computing system such as processor(s) and other circuitry 108, memory (not specifically shown), and processor-executable firmware and/or software instructions and data stored temporarily or permanently in the memory. Examples of executable instructions stored in the memory of controller 106 include a temperature-voltage control module 110, a decryption module 112, a field identity (ID) code generator 114, and an identity (ID) comparison module 116. Examples of data stored in the memory of controller 106 include subcodes 120, field ID code 122, and factory ID code 124. Controller 106 also includes an analog-to-digital (A/D) converter 118. These and other components of controller 106 operate generally to control the functions of print engine 102 and printing system 100, and to communicate with and control replaceable printing component 104 via one or more communication channels 126. In one specific implementation, the components of controller 106 operate to determine the authenticity of the replaceable printing component 104 by generating a field ID code 122 and comparing it to a factory ID code 138 stored on the printhead 128 of replaceable printing component 104, as discussed in greater detail below. Communication channel 126 is intended to represent communication channels on both the print engine 102 and replaceable printing component 104 that facilitate the transfer of data and control instructions in the form of electronic signals between the printhead 128 on replaceable printing component 104 and the controller 106 on print engine 102. A communication channel 126 can include, for example, interconnect pins or pads, metal traces, buffer circuits, and so on.

Figure 2:
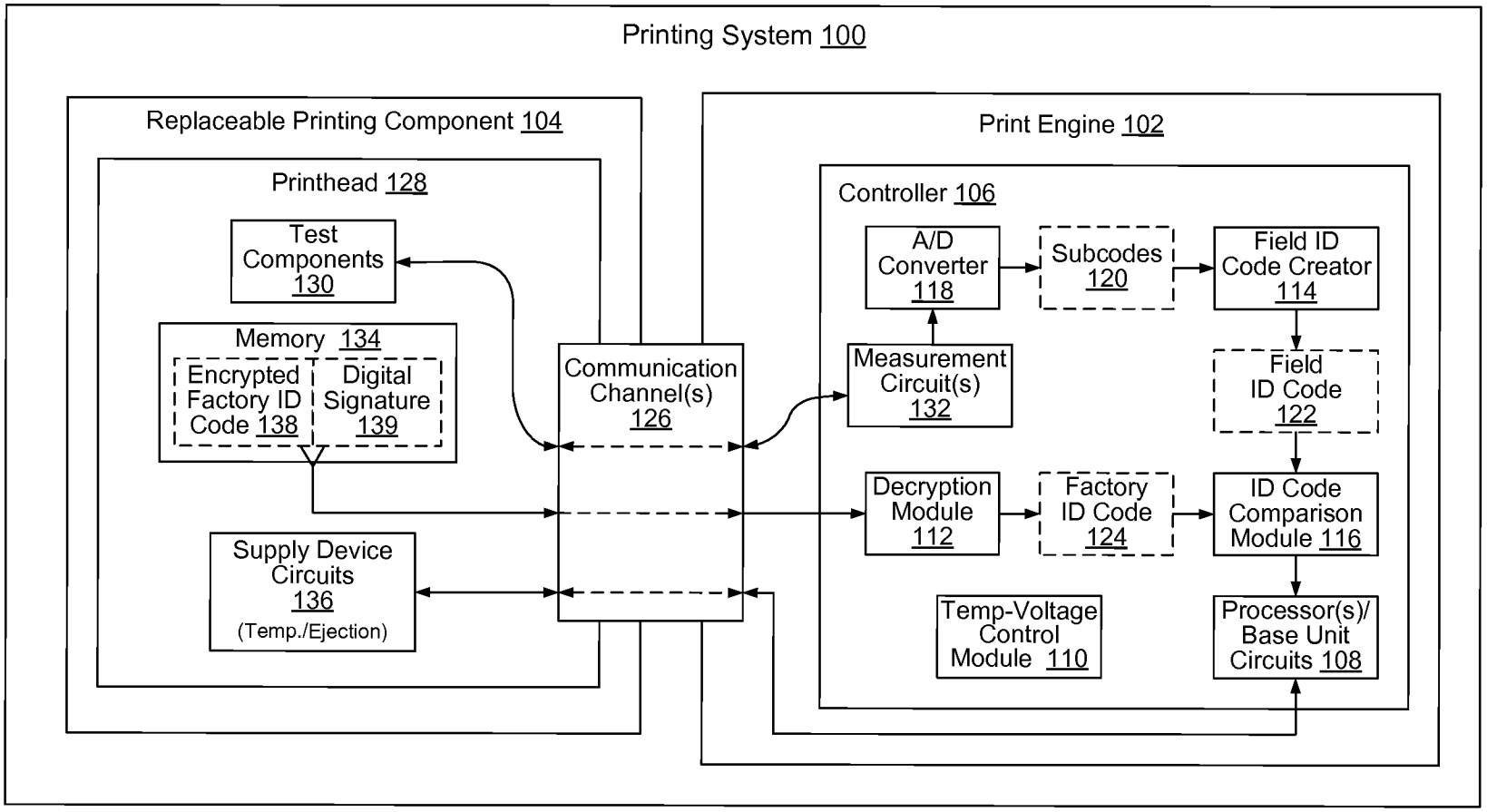
FIG. 2 shows the printing system of FIG. 1, having the measurement circuits implemented on a controller of the print engine, according to an embodiment.

Replaceable printing component 104 comprises a printhead 128 that includes a number of integrated circuit electronic test components 130, one or more measurement circuits 132, a memory 134 (e.g., non-volatile PROM), and other circuitry 136 for replaceable printing component 104. Integrated electronic test components 130 on printhead 128 can include, for example, a metal resistor, a polysilicon resistor, a thermal resistor, a PMOS transistor, an NMOS transistor, and so on. In some examples of a printing system 100, the one or more measurement circuits 132 are implemented on the controller 106 of print engine 102 instead of on the replaceable printing component 104. FIG. 2 shows the printing system 100 having the one or more measurement circuits 132 implemented on controller 106. In the implementation in FIG. 2, the replaceable printing component 104 does not include the measurement circuit(s) 132. One advantage of implementing the measurement circuit(s) 132 on the print engine 102 instead of the replaceable printing component 104 is cost savings. While having the measurement circuit(s) 132 on the print engine 102 may have a slight impact on the one-time cost of the print engine 102, the cost impact of the measurement circuit(s) 132 being on the replaceable printing component 104 would be a repeating cost to consumers that occurs each time they replace the replaceable printing component 104.

Referring generally to FIGS. 1 and 2, the printhead 128 on replaceable printing component 104 includes a factory identification (ID) code 138 stored in the memory 134 that has been previously generated during fabrication of the printhead 128. In some implementations, the factory ID code 138 may also be an encrypted factory ID code 138. The factory ID code 138 can be encrypted prior to storage in memory 134 by various encryption algorithms including, for example, RSA (Rivest-Shamir-Adleman), DSA (Digital Signature Algorithm), ECDSA (Elliptic Curve Digital Signature Algorithm), 3DES (Triple Data Encryption Algorithm) and AES (Advanced Encryption Standard). In some implementations, such as for the RSA, DSA, and ECDSA algorithms, the memory 134 will also include a digital signature 139 that accompanies the factory ID code 138. The digital signature 139 will have been generated and programmed at the factory using one of the common asymmetric signature methods, such as RSA, DSA, or ECDSA.

The generation and storage of the factory ID code 138 in the memory 134 of printhead 128 during fabrication is an initial step that enables a print engine 102 to later identify and authenticate the printhead 128 and replaceable printing component 104 when the replaceable printing component 104 is inserted into, or coupled with, the print engine 102. In general, the authentication of the printhead 128 and corresponding replaceable printing component 104 is accomplished when the print engine 102 generates a field ID code 122 and compares it with the factory ID code 138. Generating the field ID code 122 on the print engine 102 follows the same general steps that are used when generating the factory ID code 138 during fabrication of the printhead 128.

The common steps for generating an ID code (i.e., both the factory ID code 138 and field ID code 122) will now be discussed with reference to FIGS. 1 and 2. While primary reference is made to the print engine 102 and the steps it performs when generating a field ID code 122, the description applies similarly to the generation of a factory ID code 138 by an appropriate test device during fabrication of printhead 128. In general, generating an ID code 122, 138, may include regulating the temperature of the printhead 128, and setting the voltage (Vdd) of the power supply pin for the integrated circuit test components 130 on the printhead 128. Analog performance parameters are measured on all, or at least a plurality of, the test components 130. The measured analog parameters are then quantized through conversion of the analog parameters into digital values (i.e., digital subcodes 120). Additional digital subcodes 120 can then also be generated by repeating the previous measurements using different temperatures and voltages. Thus, the steps of regulating the temperature of the printhead 128 to a different temperature and setting the voltage (Vdd) to a different voltage can be repeated, followed by taking additional measurements and generating additional digital subcodes 120. The digital subcodes 120 are then combined into a field identity (ID) code 122. In the factory, during previous fabrication of the printhead 128, similar steps will already have been performed to generate the factory ID code 138, which is stored in memory 134 of printhead 128.

Addressing each step more specifically now, with reference to the print engine 102 and replaceable printing component 104 of FIGS. 1 and 2, the temperature of printhead 128 and the voltage settings of test components 130 on the printhead 128, can be controlled by a processor 108 executing instructions within the temperature-voltage control module 110. In one example, temperature elements such as thermal resistors within the replaceable printing component circuits 136 can be controlled to adjust the temperature of printhead 128. The voltage (Vdd) applied to test components 130 on printhead 128 can be set, for example, by a band gap voltage reference/source on a measurement circuit 132 or other replaceable printing component circuit 136. Control of the voltages applied to test components 130 for subsequent measurements can include, for example, sweeping the voltage level within a range of voltages. A measurement circuit 132 is controlled to measure analog performance parameters on the test components 130. As noted above, in different examples, the measurement circuit(s) 132 can be implemented either on the printhead 128 as shown in FIG. 1, or in the print engine 102 controller 106 as shown in FIG. 2.

Figure 3:
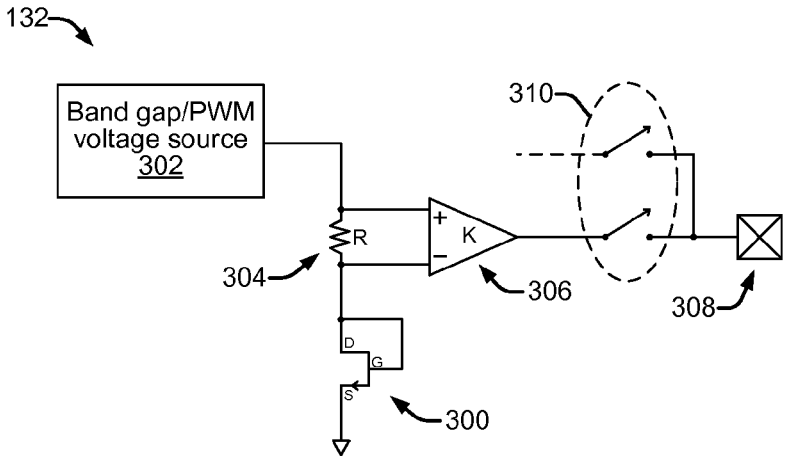
FIG. 3 shows an example of a measurement circuit that can be implemented to measure an analog parameter of a test component, according to an embodiment.

FIG. 3 shows an example of a measurement circuit 132 that can be implemented to measure an analog parameter of an electronic test component 130, according to an embodiment of the disclosure. In general, analog parameters that can be measured include the overall process performance at a given voltage and temperature determined, for example, by measuring the frequency of a ring oscillator. Examples of specific analog parameters that can be measured include the resistance of a thermal sense resistor (metal sheet rho) at a given temperature, the current through PMOS and NMOS transistors at given temperature and voltage settings, the threshold voltage of PMOS and NMOS transistors at given temperature and voltage settings, and so on. The measurement circuit 132 of FIG. 3 is configured to measure the current (i.e., saturation current) through a test component 130 implemented as a diode-connected NMOS transistor 300. A band gap or pulse-width modulated (PWM) voltage reference/source 302 is coupled to the diode-connected NMOS transistor 300 through a resistor 304. The current through the transistor 300 is converted to a voltage across resistor 304. The voltage across resistor 304 is then driven out of printhead 128 through an amplifier 306 on a multipurpose pad 308. Various functions can be output through the multipurpose pad 308 by controlling switches 310.

Figure 4:
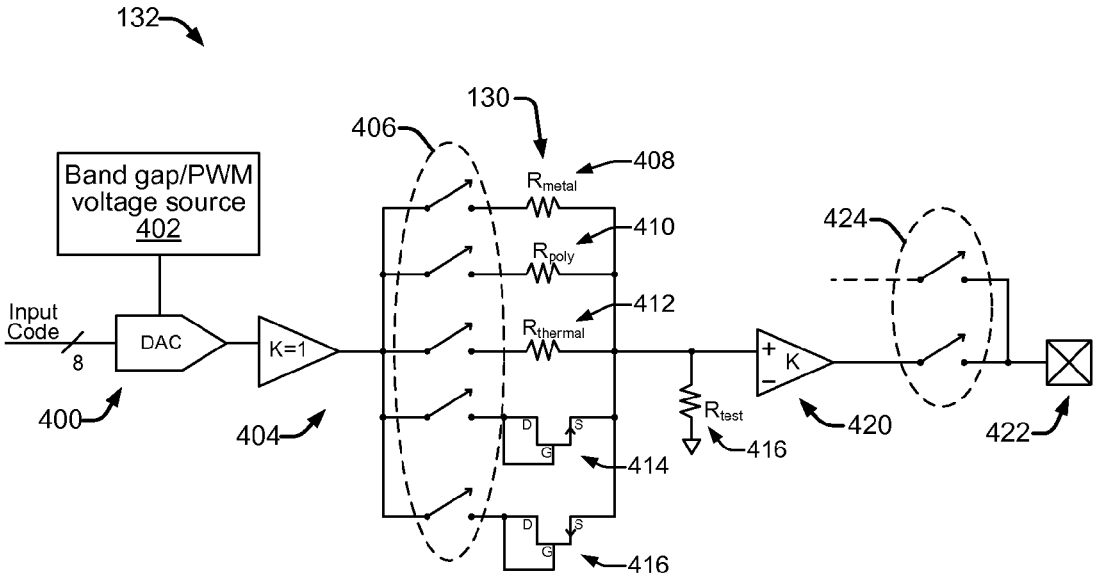
FIG. 4 shows another example of a measurement circuit that can be implemented to measure an analog parameter of a test component, according to an embodiment.

FIG. 4 shows another example of a measurement circuit 132 that can be implemented to measure an analog parameter of an electronic test component 130, according to an embodiment of the disclosure. The measurement circuit 132 of FIG. 4 includes an 8 bit digital-to-analog converter (DAC) 400 whose voltage is driven by a band gap or pulse-width modulated (PWM) voltage source 402. A desired digital code can be input to the DAC 400, and the analog output is buffered through buffer amplifier 404. Switches 406 enable switching the buffer amplifier output between various test components 130, such as a metal resistor 408, a polysilicon resistor 410, a thermal resistor 412, a diode-connected NMOS transistor 414, a diode-connected PMOS transistor 416, and so on. The output current from a test component 130 generates a voltage across a test resistor 418. The voltage across test resistor 418 is then driven out of printhead 128 through an amplifier 420 on a multipurpose pad 422. As in the previous circuit of FIG. 3, various functions can be output through the multipurpose pad 422 by controlling switches 424.

Referring again generally to FIGS. 1 and 2, each analog performance parameter that is measured by measurement circuit 132 from a test component 130 is converted by A/D converter 118 into a digital value, or digital subcode 120. As noted above, subcodes 120 can be generated for some or all of the test components 130, and numerous subcodes 120 can be generated for each individual test component 130 by repeating measurements at different temperatures and voltages. The field ID code creator 114 then executes on processor 108 to combine the subcodes 120 into a field ID code 122. Subcodes 120 can be combined in various ways including concatenating (i.e., connecting or linking in a series) the subcodes 120, blending the subcodes 120, performing mathematical operations on the subcodes 120 before and/or after combining them, taking ratios of the subcodes 120 before and/or after combining them, and so on.

Once the field ID code 122 has been generated on the print engine 102 by controller 106, the ID code comparison module 116 executes on processor 108 to compare the field ID code 122 with a factory ID code 124. The ID code comparison module 116 retrieves (i.e., reads) the factory ID code 124 from memory 134 on printhead 128. The factory ID code 124 has been previously generated during fabrication of printhead 128 in the same general manner noted above for generating the field ID code 122, and then stored in memory 134. In some implementations, the factory ID code 124 is an encrypted factory ID code 138 that has been encrypted at the factory during fabrication prior to storage in memory 134. As noted above, an encrypted factory ID code 138 can be encrypted by various encryption algorithms including, for example, RSA, DSA, ECDSA, 3DES, and AES. Where RSA, DSA, or ECDSA algorithms are used, the memory 134 will also include a digital signature 139 that accompanies the factory ID code 138. Accordingly, when an encrypted factory ID code 138 is retrieved, it is first decrypted through execution of decryption module 112 using the digital signature 139, which reveals the factory ID code 124. The ID code comparison module 116 then compares the factory ID code 124 with the field ID code 122 to determine if they match. In general, a match between the factory ID code 124 and the field ID code 122 indicates that the printhead 128, and thus the replaceable printing component 104, are authentic. If the factory ID code 124 and field ID code 122 do not match, however, then the printhead 128, and thus the replaceable printing component 104, are determined to not be authentic. When the replaceable printing component 104 is determined to not be authentic, controller 106 may provide an output message on a user interface (not shown) of the printing system 100 that indicates that the replaceable printing component 104 is, for example, not authentic, is counterfeit, has been tampered with, and so on.

When comparing the factory ID code 124 with the field ID code 122, the ID code comparison module 112 may also compensate for quantization (i.e., analog-to-digital (A/D) conversion) problems. For example, when a first analog parameter is measured in the factory on a test component 130 to generate the factory ID code 124, the A/D conversion process may assign a digital value of 156 for the measured analog parameter. However, when the same analog parameter is measured on the same test component 130 under the same conditions (e.g., temperature, voltage level) at a later time in the field by the print engine 102 to generate the field ID code 122, the A/D conversion process may yield a digital value that is off by a fraction of the lowest quantizable code (i.e., off by part of a "least significant bit"), which could result in a value of 155, instead of 156. While these values are close to a match, a straight comparison would typically result in a determination that there is no match between the factory ID code 124 and field ID code 122, which would be an incorrect result. This quantization issue can be remedied by quantizing the measured analog parameters at a finer level than the quantization level needed to discriminate between an authentic and non-authentic printhead 128 (i.e., replaceable printing component 104). In other words, additional bits can be used in the quantization (A/D conversion) such that the resolution of the difference between authentic and non-authentic printheads 128 is significantly greater than the resolution of the difference between an initial factory measured analog parameter and a subsequent field measured analog parameter of the same test component 130. The extra resolution enables the observation of "overlap" between the initial and subsequent measurements, which effectively examines the codes at a lower level of resolution and allows near neighbor codes to be a match.

Figure 5:
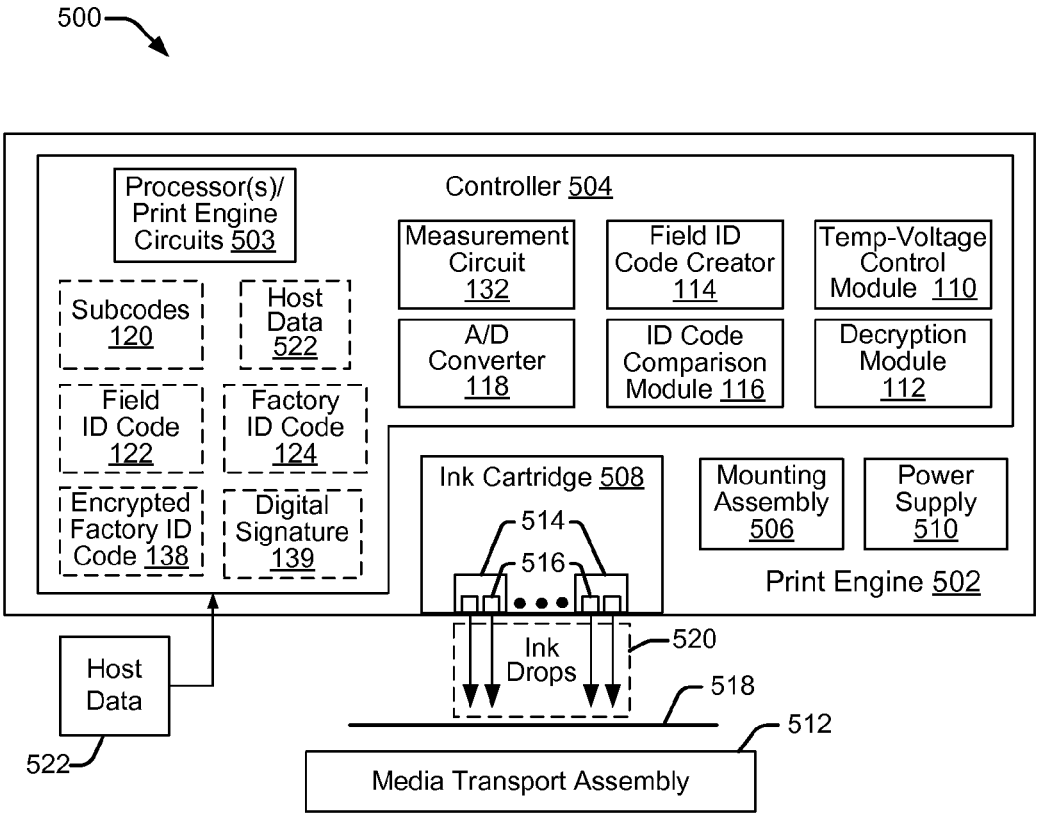
FIG. 5 shows an example of a printing system embodied as an inkjet printing system, according to an embodiment.

FIG. 5 shows a more specific example of a printing system 100 embodied as an inkjet printing system 500, according to an embodiment of the disclosure. In one implementation, the inkjet printing system 500 includes a print engine 502 having a controller 504, a mounting assembly 506, one or more replaceable printing components 104 embodied as ink cartridges 508, at least one power supply 510 that provides power to the various electrical components of inkjet printing system 500, and a media transport assembly 512. An ink cartridge 508 is a replaceable printing component for the inkjet printing system 500 that includes a printhead 514. Printhead 514 functions as both a data storage chip and as a fluid ejection device that ejects fluid ink through nozzles 516.

The controller 504 of print engine 502 generally includes components of a standard computing system such as a processor(s)/circuits 503, a memory (not specifically shown), and processor-executable firmware and/or software instructions and data stored temporarily or permanently in the memory. Examples of executable instructions stored in the memory of controller 504 include a temperature-voltage control module 110, a decryption module 112, a field identity (ID) code generator 114, and an identity (ID) code comparison module 116. Examples of data stored in the memory of controller 504 include subcodes 120, a field ID code 122, and a factory ID code 124. In some implementations, the factory ID code 124 is an encrypted factory ID code 138. Controller 504 also includes an analog-to-digital (A/D) converter 118 and a measurement circuit 132. In some implementations, the measurement circuit 132 is located on the printhead 514 within the replaceable ink cartridge 508. In general, these and other components of controller 504 operate to control the functions of print engine 502 and printing system 500, and, to communicate with and control the replaceable ink cartridge 508 and printhead 514 via one or more communication channels 126 implemented, in part, as electrical contacts 600 (see FIG. 6). In one specific implementation, the components of controller 504 operate to determine the authenticity of the ink cartridge 508 by generating a field ID code 122, and by comparing the field ID code 122 to a factory ID code 124 previously stored on the printhead 514 within ink cartridge 508, as discussed in greater detail below.

Figure 6:
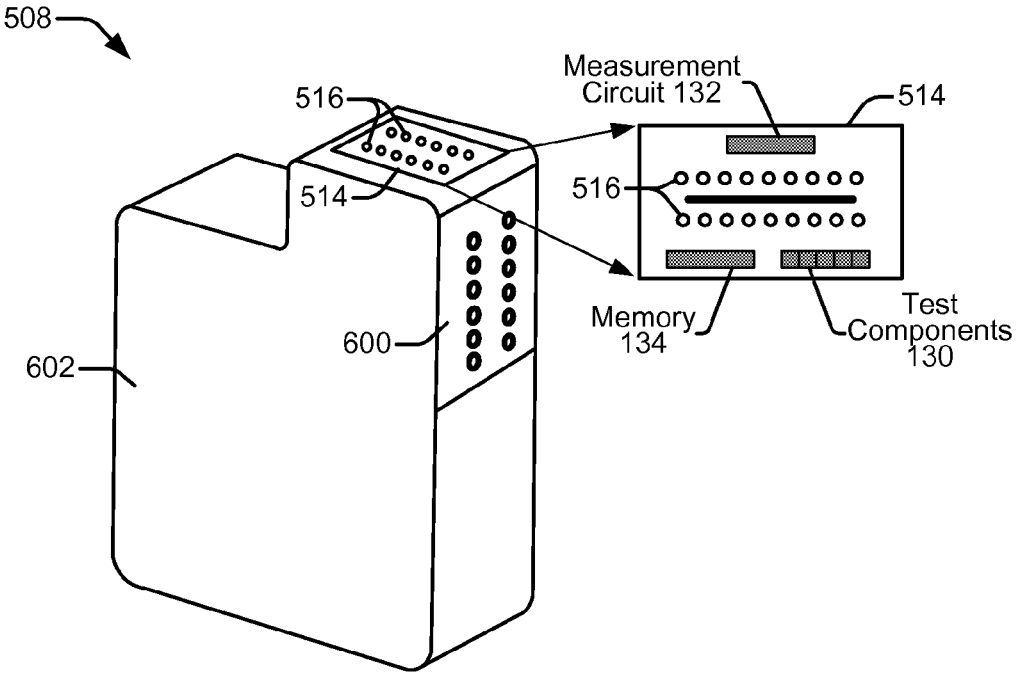
FIG. 6 shows a perspective view of an example replaceable printing component embodied as an inkjet printing cartridge, according to an embodiment.

FIG. 6 shows a perspective view of an example inkjet cartridge 508, according to an embodiment of the disclosure. Inkjet cartridge 508 is a replaceable printing component that includes a printhead 514, a group of electrical contacts 600 (i.e., communication channels 126), and an ink/fluid supply chamber 602. In some implementations, inkjet cartridge 508 may have a supply chamber 602 that stores one color of ink, and in other implementations it may have a number of chambers 602 that each store a different color of ink. Electrical contacts 600 comprise communication channels 126 that carry electrical signals from controller 504 to ejection elements (e.g., thermal resistors) on printhead 514 to cause the ejection of fluid drops through nozzles 516. Electrical contacts 600 also carry electrical signals between the controller 504 and memory 134, and between the controller 504 and electronic test components 130 on printhead 514. In some implementations where a measurement circuit 132 is located on printhead 514, electrical contacts 600 carry electrical signals between the controller 504 and the measurement circuit 132 on the printhead 514. Thus, printhead 514 serves not only as a fluid ejection device, but also as a data storage chip with a memory 134 that stores a factory ID code 124, test components 130, and a measurement circuit 132 (in some implementations), that function to help determine whether or not an inkjet cartridge 508 is authentic, in a manner similar to that discussed above regarding the printing system 100 of FIGS. 1 and 2.

Referring still to FIGS. 5 and 6, printhead 514 ejects drops of ink or other fluid through a plurality of orifices or nozzles 516 toward a print medium 518, so as to print onto print medium 518. Print media 518 can be any type of suitable sheet or roll material, such as paper, card stock, transparencies, Mylar, polyester, plywood, foam board, fabric, canvas, and the like. Printhead 514 can be configured to eject ink through nozzles 516 in a variety of ways. For example, a thermal inkjet printhead ejects drops from a nozzle by passing electrical current through a heating element (e.g., thermal resistor) to generate heat and vaporize a small portion of the ink within a firing chamber. The vapor bubble forces a drop of ink through the nozzle 516. In another example, a piezoelectric inkjet printhead uses a piezoelectric material actuator to generate pressure pulses that force ink drops out of a nozzle 516. Nozzles 516 are typically arranged in one or more columns or arrays along printhead 514 such that properly sequenced ejection of ink from the nozzles 516 causes characters, symbols, and/or other graphics or images to be printed on print media 518 as inkjet cartridge 508 and print media 518 are moved relative to each other.

Mounting assembly 506 positions inkjet cartridge 508 relative to media transport assembly 512, and media transport assembly 512 positions print media 518 relative to inkjet cartridge 508. Thus, a print zone 520 is defined adjacent to nozzles 516 in an area between inkjet cartridge 508 and print media 518. In one example, print engine 502 is a scanning type print engine 502. As such, mounting assembly 506 includes a carriage for moving inkjet cartridge 508 relative to media transport assembly 512 to scan print media 518. In another example, print engine 502 is a non-scanning type print engine 502. As such, mounting assembly 506 fixes inkjet cartridge 508 at a prescribed position relative to media transport assembly 512 while media transport assembly 512 positions print media 518 relative to inkjet cartridge 508.

As noted above, controller 504 operates to control the functions of the print engine 502 and printing system 500, and, to communicate with and control the replaceable ink cartridge 508 and printhead 514 via electrical contacts 600 (i.e., communication channels 126). Controller 504 receives host data 522 from a host system, such as a computer, and temporarily stores the data 522 in a memory. Typically, data 522 is sent to inkjet printing system 500 along an electronic, infrared, optical, or other information transfer path. Host data 522 represents, for example, a document and/or file to be printed. As such, data 522 forms a print job for inkjet printing system 500 that includes one or more print job commands and/or command parameters. Using data 522, controller 504 controls inkjet cartridge 508 to eject ink drops from nozzles 516. Thus, controller 504 defines a pattern of ejected ink drops that forms characters, symbols, and/or other graphics or images on print medium 518. The pattern of ejected ink drops is determined by the print job commands and/or command parameters from data 522.

In another implementation, the controller 504 operates to determine the authenticity of the printhead 514 and ink cartridge 508 in a manner similar to that discussed above with respect to the printing system 100 of FIGS. 1 and 2. The controller 504 determines the authenticity of the printhead 514 and corresponding ink cartridge 508 when the ink cartridge 508 is inserted into the printing system 500, by comparing a generated field ID code 122 with the factory ID code 138 that has been previously stored on the printhead 514 during fabrication of the printhead 514. The controller 504 creates the field ID code 122 by implementing the same general steps and conditions used to create the factory ID code 138 during the printhead fabrication. To generate the field ID code 122, the controller 504 measures analog performance parameters of a plurality of the test components 130 on printhead 514. As an initial step, the controller 504 may regulate the temperature of the printhead 514 and set the voltage levels (Vdd) of the test components 130, through the processor 503 executing instructions in the temperature-voltage control module 110. For example, controller 504 can adjust the printhead temperature by stimulating thermal resistors (e.g., thermal fluid ejection elements) on printhead 514, and set the voltage (Vdd) applied to test components 130 by controlling a band gap or PWM voltage source within measurement circuit 132, located either on controller 504 or on the printhead 514. As indicated in FIGS. 5 and 6, the measurement circuit 132 can be implemented on either the printhead 514, or on the controller 504 of printing system 500. Once the temperature and voltages have been set on printhead 514, the measurement circuit 132 can measure analog parameters from the test components 130. Some examples of such measurement circuits 132, test components 130, and measured parameters are discussed above with respect to FIGS. 3 and 4.

The measured analog parameters are converted, or quantized, by A/D converter 118 into digital values, or digital subcodes 120. Subcodes 120 can be generated for some or all of the test components 130 on printhead 514. Furthermore, numerous subcodes 120 can be generated for each individual test component 130 on printhead 514 by repeating measurements at different temperatures and voltages.

The field ID code creator 114 executes on processor 503 to combine the subcodes 120 into a field ID code 122. Subcodes 120 can be combined in various ways. For example, the subcodes 120 can be concatenated (i.e., connected or linked in a series), blended (e.g., mixing digits in different combinations), operated on with different mathematical functions before and/or after combining them, including taking ratios of the subcodes 120 before and/or after combining them, and so on.

After the field ID code 122 is generated through the combination of a number of subcodes 120, controller 504 executes instructions from the ID code comparison module 116 on processor 503 to compare the field ID code 122 with a factory ID code 124. The ID code comparison module 116 retrieves (i.e., reads) the factory ID code 124 from memory 134 on printhead 514. As noted above, the factory ID code 124 has been previously generated and stored in memory 134 during fabrication of the printhead 514 in the same general manner noted above for generating the field ID code 122. In some implementations, the factory ID code 124 is an encrypted factory ID code 138 that is encrypted at the factory during fabrication prior to storage in the printhead memory 134. An encrypted factory ID code 138 can be encrypted by various encryption algorithms including, for example, RSA (Rivest-Shamir-Adleman), DSA (Digital Signature Algorithm), ECDSA (Elliptic Curve Digital Signature Algorithm), 3DES (Triple Data Encryption Algorithm) and AES (Advanced Encryption Standard). In some implementations, such as for the RSA, DSA, and ECDSA algorithms, the memory 134 will also include a digital signature 139 that accompanies the factory ID code 138. If the factory ID code 124 is an encrypted factory ID code 138, it is decrypted through execution of decryption module 112 using digital signature 139 upon retrieval by the comparison module 116. Decrypting the encrypted factory ID code 138 reveals the factory ID code 124 and enables the comparison module 116 to compare the field ID code 122 with the factory ID code 124. Comparing the factory ID code 124 with the field ID code 122 can include compensating for potential differences in quantization (i.e., analog-to-digital (A/D) conversion) of the measured analog parameters. As discussed above, this compensation can include quantizing the measured analog parameters at a finer level than the quantization level needed to discriminate between an authentic and non-authentic printhead 514 (i.e., replaceable ink cartridge 508).

If the factory and field ID codes match, the comparison module 116 determines that the ink cartridge 508 with printhead 514 is authentic. If the codes do not match, however, then the comparison module 116 determines that the ink cartridge 508 with printhead 514 is not authentic. When the codes do not match, comparison module 116 can provide an output message to a user interface (not shown) of the printing system 500 that indicates the ink cartridge 508 is not authentic, may be counterfeit, may have been tampered with, and so on.

Figure 7:
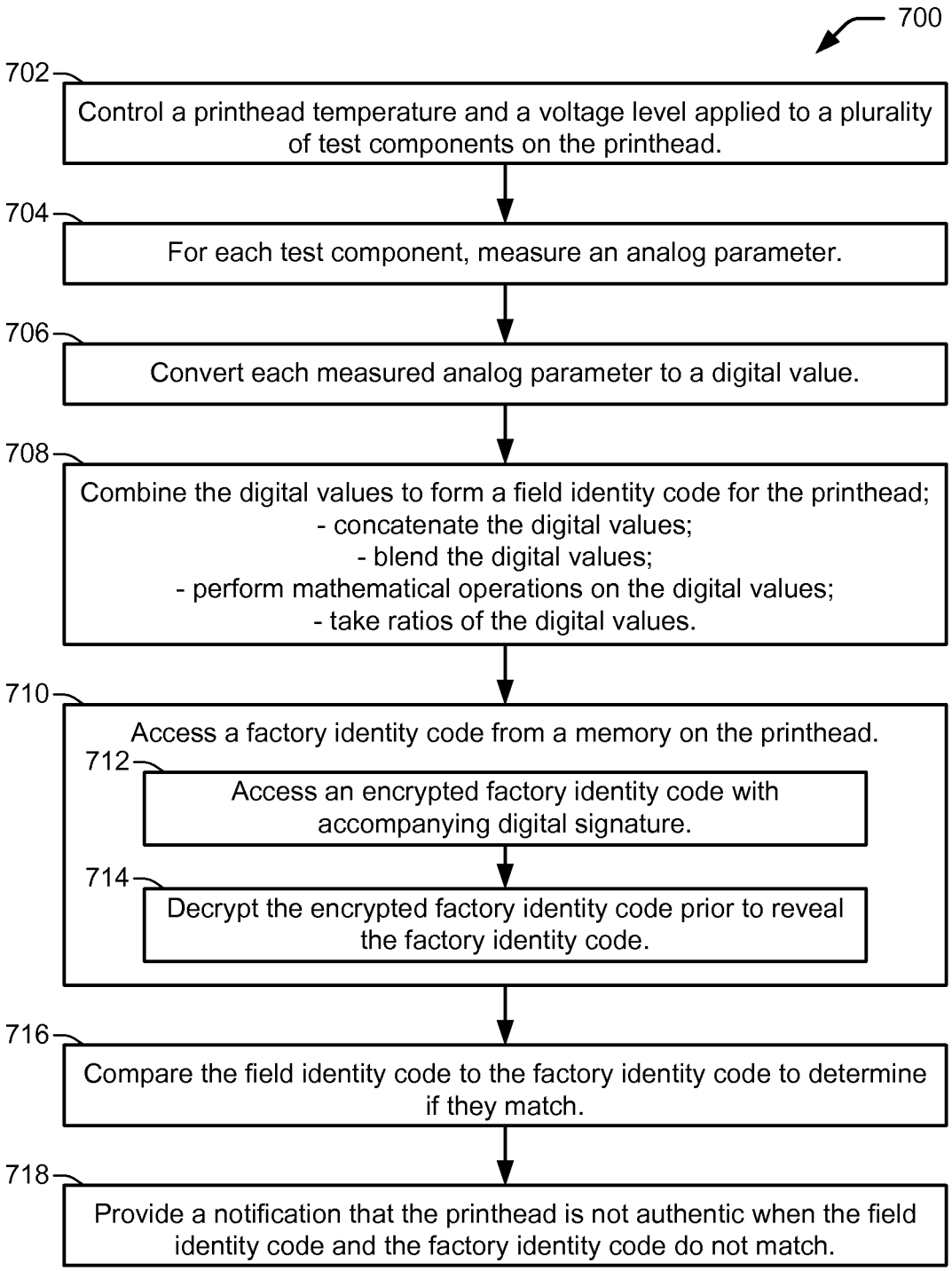
FIG. 7 shows an example method of authenticating replaceable printing components, according to an embodiment.

FIG. 7 shows an example method 700 of authenticating replaceable printing components, according to embodiments of the disclosure. Method 700 is associated with the embodiments discussed above with regard to FIGS. 1-6, and details of the steps shown in method 700, can be found in the related discussion of such embodiments. The steps of method 700 may be embodied as programming instructions stored on a non-transitory computer/processor-readable medium, such as a memory on the controllers 106 and 504 of FIGS. 1, 2, and 5. 202 and 210 of FIG. 1. In an embodiment, the implementation of the steps of method 700 is achieved by the reading and execution of such programming instructions by a processor, such as processor 108 and 503 of FIGS. 1, 2, and 5. Method 700 may include more than one implementation, and different implementations of method 700 may not employ every step presented in the flowchart. Therefore, while steps of method 700 are presented in a particular order, the order of their presentation is not intended to be a limitation as to the order in which the steps may actually be implemented, or as to whether all of the steps may be implemented. For example, one implementation of method 700 might be achieved through the performance of a number of initial steps, without performing one or more subsequent steps, while another implementation of method 700 might be achieved through the performance of all of the steps.

Referring to FIG. 7, method 700 begins at block 702 with controlling a printhead temperature and a voltage level applied to a plurality of test components on the printhead. At block 704, the method continues with measuring an analog parameter for each test component. At block 706, each measured analog parameter is converted to a digital value. The method 700 continues at block 708 with combine the digital values to form a field identity code for the printhead. There are various ways of combining the digital values, including concatenating the digital values, blending the digital values, performing mathematical operations on the digital values, and taking ratios of the digital values.

The method 700 continues at block 710 with accessing a factory ID code from the memory of the printhead. As shown at blocks 712 and 714, respectively, accessing the factory ID code can include accessing an encrypted factory ID code with an accompanying digital signature, and decrypting the encrypted factory ID code to reveal the factory ID code. At block 716, the method 700 continues with comparing the field identity code to the factory identity code to determine the codes match. As shown at block 718, if the codes do not match, a notification can be provided indicating that the printhead is not authentic. Conversely, if the does do match, a notification can be provided indicating the printhead is authentic.

What is claimed is:

1. A replaceable printing component comprising:

a fluid supply chamber;

a printhead having a memory and a plurality of test components;

an encrypted factory identification code stored in the memory that comprises a combination of digitized analog performance parameters measured on the test components, and that has been encrypted using an encryption algorithm selected from the group consisting of RSA (Rivest-Shamir-Adleman), DSA (Digital Signature Algorithm), ECDSA (Elliptic Curve Digital Signature Algorithm), 3DES (Triple Data Encryption Algorithm) and AES (Advanced Encryption Standard); and a measurement circuit on the printhead to measure the analog performance parameters, wherein the digitized analog performance parameters comprise subcodes, and the factory identification code comprises a combination of the subcodes.

2. A replaceable printing component as in claim 1, wherein the measurement circuit comprises a voltage source selected from the group consisting of a band gap voltage source and a pulse-width modulated voltage source.

3. A replaceable printing component comprising:

a fluid supply chamber;

a printhead having a memory and a plurality of test components; and an encrypted factory identification code stored in the memory that comprises a combination of digitized analog performance parameters measured on the test components, and that has been encrypted using an encryption algorithm selected from the group consisting of RSA (Rivest-Shamir-Adleman), DSA (Digital Signature Algorithm), ECDSA (Elliptic Curve Digital Signature Algorithm), 3DES (Triple Data Encryption Algorithm) and AES (Advanced Encryption Standard), wherein the test components are selected from the group consisting of a metal resistor, a polysilicon resistor, a thermal resistor, a PMOS transistor, and an NMOS transistor, and at least one test component is to couple to a voltage source selected from the group consisting of a band-gap voltage source and a pulse-width modulated voltage source.

4. A replaceable printing component comprising:

a fluid supply chamber;

a printhead having a memory and a plurality of test components; and an encrypted factory identification code stored in the memory that comprises a combination of digitized analog performance parameters measured on the test components, and that has been encrypted using an encryption algorithm selected from the group consisting of RSA (Rivest-Shamir-Adleman), DSA (Digital Signature Algorithm), ECDSA (Elliptic Curve Digital Signature Algorithm), 3DES (Triple Data Encryption Algorithm) and AES (Advanced Encryption Standard), wherein the analog performance parameters are selected from the group consisting of resistance, transistor saturation current, and transistor threshold voltage, and a first test component of the plurality of test components comprises a diode-connected NMOS transistor to couple with a voltage source.

5. A replaceable printing component comprising:

a fluid supply chamber;

a printhead having a memory and a plurality of test components; and an encrypted factory identification code stored in the memory that comprises a combination of digitized analog performance parameters measured on the test components, and that has been encrypted using, an encryption algorithm selected from the group consisting of RSA (Rivest-Shamir-Adleman), DSA (Digital Signature Algorithm), ECDSA (Elliptic Curve Digital Signature Algorithm), 3DES (Triple Data Encryption Algorithm) and AES (Advanced Encryption Standard), wherein the digitized analog performance parameters comprise subcodes, and the encrypted factory identification code comprises a combination of the subcodes selected from the group consisting of concatenated subcodes, blended subcodes, mathematically manipulated subcodes, and ratios of subcodes.

6. A replaceable printing component comprising:

a fluid supply chamber;

a printhead having a memory and a plurality of test components;

an encrypted factory identification code stored in the memory that comprises a combination of digitized analog performance parameters measured on the test components, and that has been encrypted using; an encryption algorithm selected from the group consisting of RSA (Rivest-Shamir-Adleman), DSA (Digital Signature Algorithm), ECDSA (Elliptic Curve Digital Signature Algorithm), 3DES (Triple Data Encryption Algorithm) and AES (Advanced Encryption Standard; and a digital signature stored in the memory for decrypting the encrypted factory identification code, wherein a first test component of the plurality of test components is to couple to a band gap voltage source.

7. A replaceable printing component comprising:

a fluid supply chamber;

a printhead on the fluid supply chamber having a memory storing a factory identification code that comprises a combination of digitized analog performance parameters;

electronic test components on the printhead from which the analog performance parameters have been measured; and a measurement circuit on the printhead to measure the analog performance parameters, the measurement circuit comprising a digital-to-analog converter, and at least one electronic test component is coupled to the measurement circuit.

8. A replaceable printing component comprising;

a fluid supply chamber;

a printhead on the fluid supply chamber having a memory storing a factory identification code that comprises a combination of digitized analog performance parameters; and electronic test components on the printhead from which the analog performance parameters have been measured, wherein the factory identification code is an encrypted factory identification code with an accompanying digital signature stored in the memory, wherein the digitized analog performance parameters comprise subcodes, and the factory identification code comprises a combination of the subcodes.

9. A replaceable printing component as in claim 8, wherein the encrypted factory identification code is encrypted using an encryption algorithm selected from the group consisting of a triple data encryption algorithm and an advanced encryption standard.

10. A replaceable printing component comprising:

a fluid supply chamber;

a printhead on the fluid supply chamber having a memory storing a factory identification code that comprises a combination of digitized analog performance parameters; and electronic test components on the printhead from which the analog performance parameters have been measured; wherein the test components are selected from the group consisting of a metal resistor, a polysilicon resistor, a thermal resistor, a PMOS transistor, and an NMOS transistor, and at least one test component is to couple to a measurement circuit comprising a digital-to-analog converter.

11. A replaceable printing component comprising:

a fluid supply chamber;

a printhead on the fluid supply chamber having a memory storing a factory identification code that comprises a combination of digitized analog performance parameters; and electronic test components on the printhead from which the analog performance parameters have been measured, wherein the analog performance parameters are selected from the group consisting of resistance, transistor saturation current, and transistor threshold voltage wherein a first electronic test component on the printhead is to couple to a voltage source selected from the group consisting of a band-gap voltage source and a pulse-width modulated voltage source.

12. A replaceable printing component as in claim 7, wherein the measurement circuit comprises:

a pulse-width modulated voltage source; and a diode-connected NMOS transistor coupled to the pulse-width modulated, voltage source through a resistor.

13. A replaceable printing component comprising:

a fluid supply chamber;

a printhead on the fluid supply chamber having a memory storing a factory identification code that comprises a combination of digitized analog performance parameters; and electronic test components on the printhead from which the analog performance parameters have been measured, wherein the digitized analog performance parameters comprise subcodes, and the factory identification code comprises a combination of the subcodes selected from the group consisting of concatenated subcodes, blended subcodes, mathematically manipulated subcodes, and ratios of subcodes.

* * * * *